United States Patent [19]

Frye

[11] 4,009,780

[45] Mar. 1, 1977

[54] VOLLEYBALL OR LIKE KIT

[76] Inventor: Norman V. Frye, R.R. 4, Davenport, Iowa 52804

[22] Filed: May 24, 1976

[21] Appl. No.: 689,058

[52] U.S. Cl. ..... 206/315 R; 206/443; 273/29 R

[51] Int. Cl.[2] ..... B65D 85/20

[58] Field of Search ..... 46/11; 52/157; 206/223, 206/315 R, 315 B, 443; 273/29 R, 95 H

[56] References Cited

UNITED STATES PATENTS

| | | | |
|---|---|---|---|
| 2,680,514 | 6/1954 | St. Pierre | 206/315 R X |
| 3,105,682 | 10/1963 | Ahnens | 273/29 R |
| 3,272,329 | 9/1966 | Mehalov | 206/443 |
| 3,328,928 | 7/1967 | Frye | 273/29 R X |

FOREIGN PATENTS OR APPLICATIONS

| | | | |
|---|---|---|---|
| 599,727 | 3/1948 | United Kingdom | 273/95 H |

*Primary Examiner*—Steven E. Lipman

[57] ABSTRACT

An assemblage of components for playing volleyball is arranged in a kit for convenient packaging, storing and handling, the components comprising a pair of Z-shaped ground anchors and a plurality of post sections arranged in two sets of three post sections per set. The anchors have cylindrical parts through which two of the post sections are passed when packaged, with the other four sections in parallelism, and a pair of end members is provided for retaining the posts with the ground anchors of course retained in turn by the first two posts. As a further adjunct, a volleyball net is packaged in the kit and is retained by the means securing the end members together.

12 Claims, 11 Drawing Figures

VOLLEYBALL OR LIKE KIT

BACKGROUND OF THE INVENTION

Volleyball and like components of the general class referred to here are disclosed in present applicant's U.S. Pat. Nos. 3,636,670; 3,328,928; 3,076,532; and 3,197,928. Although these do not show the specific type of ground anchors dealt with here, they will suffice to illustrate that a typical ground anchor has a generally Z-shape, including a ground-penetrating part, a post-supporting part and a leg extending between and interconnecting the two parts, the parts extending respectively in opposite directions from the leg and lying generally on parallel or somewhat parallel axes. Although these patents may not show the end-to-end post sections, it may be accepted that such arrangement of post sections per se has been heretofore used by applicant. It will thus be seen that packaging presents a problem, there being several discrete parts, and particularly the Z-shaped anchors have heretofore virtually defied simple, economical and attractive packaging.

According to the present invention, the design of the anchors has been altered so that the ground-penetrating and post-receiving parts are tubular or generally so and lie on virtually parallel axes, with the leg being tangentially connected to both parts. Since the parts are hollow, they enable two of the post sections to be passed therethrough; i.e., one post section through one pair of coaxially arranged parts and the other post section through the other alined parts. The length of the legs (equal for both legs) determines the spacing between the two post sections. Since the tubular parts are tangential to the parts at the same sides thereof there is no "cross-over"; i.e., the remaining space between the two posts on which the anchors are strung is unobstructed and the additional post sections occupy this space in the kit or package.

The post sections are of equal length, or nearly so, and the package includes a pair of end members engaging the post sections at opposite ends and the two end members are releasably secured together with the post sections between them. Each end member is provided with a plurality of confining means spaced apart cross-wise of the package-assembled post sections and retains the desired spacing. A net may be packaged along with the post sections and anchors, being retained by the securing means. The end members may have provision for carrying advertising, display, etc. cards.

Setting up for play requires merely separating the parts from the end members, putting the members aside for further use and erecting the anchors and posts and connecting the net.

DESCRIPTION OF A PREFERRED EMBODIMENT

Figure 1:
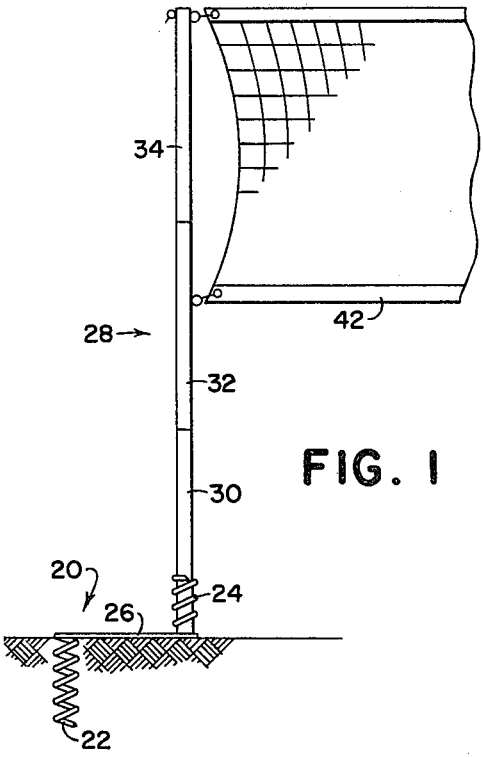
FIG. 1 is a fragmentary "environmental" view of the components assembled for play.

FIG. 1 will be referred to first as general background. The numeral 20 designates one of the two identical ground anchors, here shown as having a ground-penetrating part in the form of a helix 22, a post-supporting part 24, also a helix, and a straight leg 26 interconnecting the two helices. Preferably the anchor is a one-piece member of rod-like steel or the like, and each helix is wound in any suitable manner so that the two have the same inside and outside diameters. Obviously, their general nature is such that they are of course cylindrical and hollow.

Figure 2:
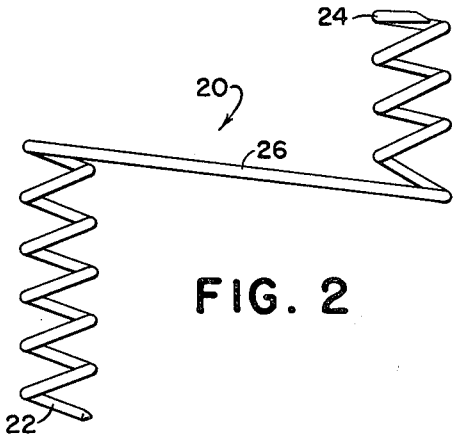
FIG. 2 is an enlarged elevation of one of the anchors.

FIG. 2 shows that the leg 26 has an angle of less than 90° with each helix and, the leg being straight and the helices being formed about parallel axes, these angles will be equal. The purpose of this design, not vital to the present invention, is to enable the anchor to be screwed into the ground, via the helix 22, until the bottom of the helix 24 just contacts the ground. Thereafter, the leg is manually lifted and deeper screwing of the anchor into the ground causes the leg to lie flat on the ground, with the result that the helix 24 tilts toward the axis extended of the helix 22. When the posts and net are in place and the net properly tensioned, the posts will be upright as shown in FIG. 1. This particular design is the subject matter of applicant's co-pending application Ser. No. 689,056, filed May 24, 1976.

Figure 9:
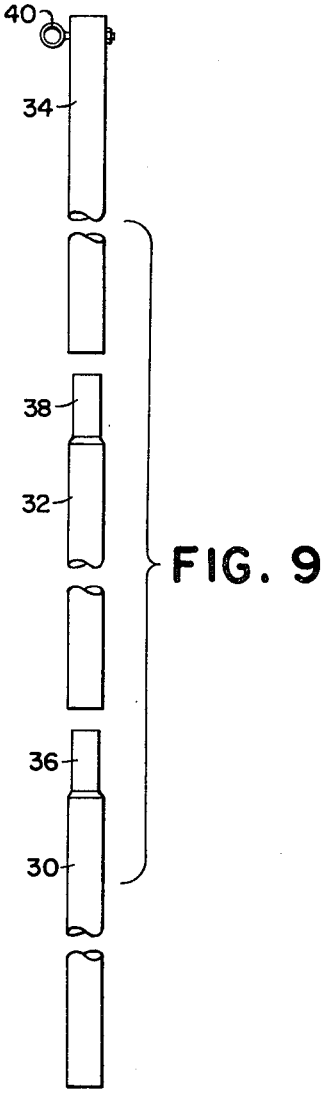
FIG. 9 is an "exploded" view, on a different scale, showing how the post sections may be assembled for play.

Each post, denoted generally at 28 in FIG. 1, is comprised of three parts or sections 30, 32 and 34 (FIG. 9). The post section 30 is reduced at 36 to fit into the hollow end of the next post section 32, which is likewise reduced at 38 to fit into the hollow end of the section 34. The top section may have en eye 40 for connecting a net 42.

Figure 11:
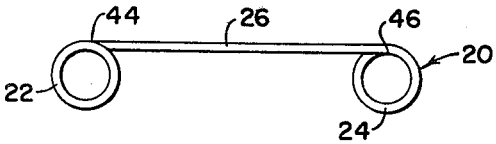
FIG. 11 is a plan of the anchor shown in FIG. 2.

A significant feature of the design is that the helices are tangential to the leg 26 at the same side (FIG. 11); that is, the helix 22 is tangent to the leg at 44 and the helix 24 is tangent to the leg at 46 and the points of tangency are in a straight line. Stated in another way: the leg joins the helix 22 at its first turn and also joins the helix 24 at its first turn, the helices being wound in the same direction. This avoids any diagonal cross-over of the leg from one helix to the other, which is important from the standpoint of enabling easy packaging, as will appear subsequently.

Figure 3:
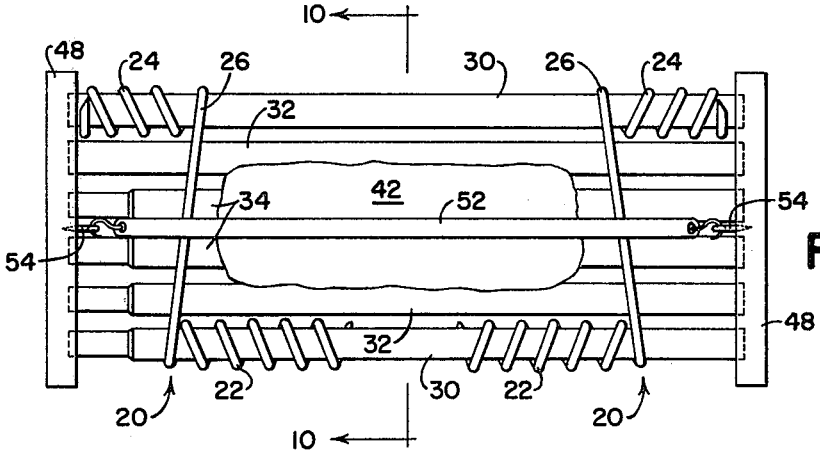
FIG. 3 is a reduced-scale elevation of the assembled kit or package.
Figure 5:
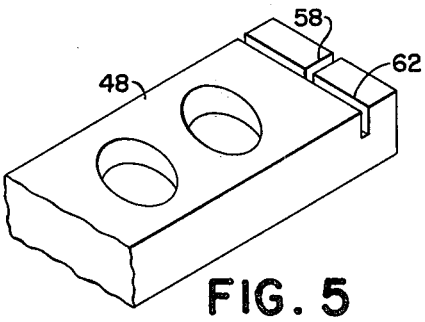
FIG. 5 is an enlarged part view, in perspective, illustrating details of an end member.
Figure 10:
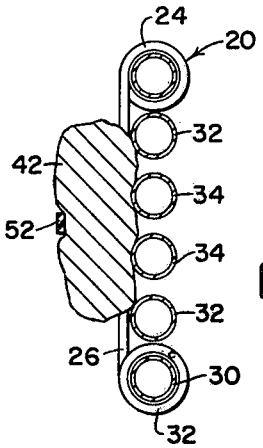
FIG. 10 is a section on the line 10-10 of FIG. 3.

Reference will now be made to FIGS. 3 and 10 for the details of the package or kit. As seen there, the two anchors, which are identical, are arranged so that one is a Z and the other a "reverse" Z. The two helices 22 are coaxial on one axis and the two helices 24 are coaxial on a parallel axis. The legs 26 extend cross-wise or transaxially as respects these two axes. The length of the legs determines, for one thing, the spacing between these two axes. The post sections 30 are passed respectively through the alined helices, and the remaining post sections (four in number) are laid parallel to the post sections 30 and against the legs (considering the kit flat-wise and not as seen in FIG. 10). This brings out the significance of the legs lying at the same tangential sides of the helices, because room or space is provided for accommodating the remaining four post sections, it being understood that the post sections are arranged in two sets, three sections to a set. If the legs were not so designed, they would cross over diagonally of the assemblage and obstruct receipt of the four additional posts.

Figure 4:
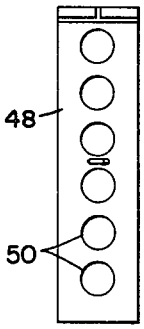
FIG. 4 is a face view of one of the end members.
Figure 8:
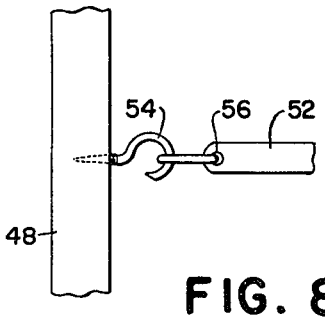
FIG. 8 is an enlarged part view showing one form of connection of the securing means to an end member.

As previously stated, the post sections are of equal length or nearly so. This determines the length of the package and enables the ends of the post sections to be engaged by a pair of end members 48. Each member 48 is provided with means for confining the post sections at their ends. This means preferably comprises a plurality of circular recesses 50 (FIG. 4), here six in number because there are six post sections. Since these are spaced apart and receive the associated ends of the post sections, they maintain the transaxial spacing of the post sections, at the same time confining the sections against relative axial movement, because the members are releasably interconnected or secured together, here by an elastic member 52. Each end member has a receiver means or hook 54 (FIG. 8) which is connected to the associated end of the elastic member via an opening 56 in the latter, the elasticity in the member 52 serving to draw the members together with the post sections confined between them. Of course, the two posts 30 are retained by, and retain, the two anchors. To complete the assemblage, the net 42 may be wrapped as desired and slipped under the elastic member and thus be retained thereby (FIGS. 4 and 10). The package may be carried via one of the posts 30 as a handle.

Figure 6:
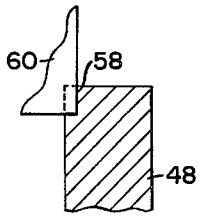
FIG. 6 is an enlarged fragmentary view, partly in section, illustrating one form of display-card-receiving means on an end member.
Figure 7:
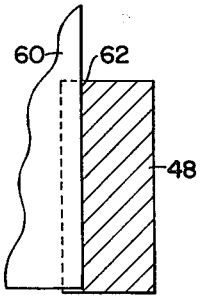
FIG. 7 is a similar view, showing another form.

For receiving advertising, display, etc. media, the members 48 have means in the form of pairs of slots. Each member has a first slot 58 and these are lengthwise alined to receive a card as at 60 (FIG. 6); and a second slot 62, and these slots are also alined to receive the card (FIG. 7). The slots are normal to each other so that the kit can be disposed in either the FIG. 10 position, in which the slots 58 receive the card, or in a flat position in which the slots 62 receive the card.

The package or kit presents a simple, economical and attractive assemblage and is virtually self-contained; i.e., its major components virtually support themselves and accomplish the task of readily packaging discrete items. The only parts not used in play are the end members and the retaining strap or member 52. The end members may be constructed of any suitable lightweight material, such as wood, plastic, foamed plastic or the like. The elastic member 52 may be a conventional tarpaulin strap of rubber or the like. These are all matters of choice.

I claim:

1. A kit for use in playing volleyball or the like, comprising a pair of generally Z-shaped ground anchors, each having a ground-penetrating helix, a post-supporting helix, and a leg extending between and interconnecting the helices, the helices being formed on parallel axes and extending respectively in opposite directions from the leg, the leg joining each helix at its respective first turn and said helices being tangential to the leg at the same side thereof, said anchors being arranged in the kit with the one helix of one anchor in axial alinement with one helix of the other anchor and the other two helices being in coaxial alinement with each other, and with the legs spaced apart axis-wise as respects the helices; a plurality of net post sections of substantially equal length including a first section passed through one pair of coaxial helices and a second section passed through the other pair of co-axial helices; a pair of end members respectively engaging opposite ends of the post sections; and means releasably securing the end members together with the post sections confined between them.

2. The invention defind in claim 1, in which the plurality of post sections includes additional sections like the first and second sections and interposed between and paralleling the first and second sections and engaged at their respective opposite ends by the end members.

3. The invention defined in claim 2, in which the securing means includes a member extending between and connected to the end members in overlying relation to certain of the post sections, and a volleyball or like net carried between said member and said certain of the post sections.

4. The invention defined in claim 2, in which each end member has a plurality of recesses therein spaced apart cross-wise of the post sections for receiving and confining the associated ends of the post sections in spaced relation to each other.

5. The invention defined in claim 2, in which the securing means includes an elastic element for drawing the end members together.

6. The invention defined in claim 5, in which each end member has a receiving means thereon and the elastic member is connected at opposite ends to the respective receiving means.

7. The invention defined in claim 2, in which at least one of the end members includes means for receiving a display card or the like.

8. The invention defined in claim 7, in which said one end member includes additional receiving means for receiving a display card or the like.

9. The invention defined in claim 8, in which both end members have dual card-receiving means thereon, each dual means including a pair of slots, the slots in each pair being normal to each other and the pairs of slots being alined and facing toward and matching each other.

10. A kit for use in playing volleyball or the like, comprising a pair of generally Z-shaped ground anchors, each having a generally cylindrical, hollow ground-penetrating part, a generally cylindrical, hollow post-supporting part, and a leg extending between and interconnecting the parts, the parts lying respectively on parallel axes and extending in opposite directions from the leg, said parts being tangential to the leg at the same side thereof, said anchors being arranged in the kit with two of the parts coaxial and with the other two parts also coaxial on an axis spaced from that of the first two parts and with the legs spaced axially apart; a plurality of net post sections of substantially equal length, including a first post section passed through the one pair of alined parts and a second post section passed through the other pair of alined parts; a pair of end members respectively engaging opposite ends of the post sections; and means releasably securing the end members together with the post sections confined between them.

11. The invention defined in claim 10, in which the plurality of post sections includes additional post sections so as to provide two sets of three sections each, and the three sections of each set are adapted to fit together in end-to-end relation.

12. The invention defined in claim 11, in which each end member has therein a plurality of confining means spaced apart according to the number of post sections and engaging the associated ends of the post sections to space the post sections apart in the assembled kit.

* * * * *